US006488431B1

(12) United States Patent
Bocola

(10) Patent No.: US 6,488,431 B1
(45) Date of Patent: Dec. 3, 2002

(54) CAPSULE FOR CONTROLLABLY METERING PRODUCTS HELD IN BOTTLES OR THE LIKE

(76) Inventor: Giovanni Bocola, Via Tonale, 9, 20125, Milan (IT)

( * ) Notice: Subject to any disclaimer, the term of this patent is extended or adjusted under 35 U.S.C. 154(b) by 0 days.

(21) Appl. No.: 09/555,538

(22) PCT Filed: Jul. 17, 1998

(86) PCT No.: PCT/IT98/00201

§ 371 (c)(1),
(2), (4) Date: May 31, 2000

(87) PCT Pub. No.: WO99/30592

PCT Pub. Date: Jun. 24, 1999

(30) Foreign Application Priority Data

Dec. 16, 1997 (IT) ..... MI970902 U

(51) Int. Cl.[7] ..... B43K 7/10

(52) U.S. Cl. ..... 401/216; 401/213; 401/209; 401/212

(58) Field of Search ..... 401/208, 202, 401/213, 216, 212, 214

(56) References Cited

U.S. PATENT DOCUMENTS 2,998,616 A * 9/1961 Gentile ..... 401/213
6,095,708 A * 8/2000 Butaud ..... 401/213

* cited by examiner

*Primary Examiner*—David J. Walczak
(74) *Attorney, Agent, or Firm*—Hedman & Costigan, P.C.

(57) ABSTRACT

A capsule for controllably metering products held in bottles comprising a ball element for controllably delivering the product on a delivery surface, the ball element housed inside a holding body provided with a cover which can be opened for exposing the top portion of the ball element, as well as with a threaded portion engaging with a corresponding threaded portion provided on the neck of the bottle.

2 Claims, 3 Drawing Sheets

CAPSULE FOR CONTROLLABLY METERING PRODUCTS HELD IN BOTTLES OR THE LIKE

The present application is the national stage filing of and claims priority to International Application No. PCT/IT98/00201, filed Jul. 17, 1998 and Italian Application Serial No. MI97U000902.

BACKGROUND OF THE INVENTION

The present invention relates to a capsule for controllably metering products held in bottles or the like.

In the cosmetic field, as well as in other fields in which products must be delivered in metered amounts on a delivery surface, metering capsules including in their inside delivery ball elements are already known.

These metering capsule conventionally comprise a rod element, arranged in the bottle neck, and a ball element in turn engaged in a mating seat having a substantially circular rim, and provided on said rod element.

This rod-ball element assembly is protected by a capsule or cap threaded on the threaded neck of the bottle.

In particular, the ball element partially projects from the bottle neck and is free of rotating in its engagement seat, as said ball element contacts the product application or delivery surface, thereby gradually delivering said product.

While the above mentioned prior metering capsule allows to controllably deliver or meter the product, it, on the other hand, has a rather complex construction, since for making it three different component elements are required.

In this connection it should be pointed out that constructional complexity of prior metering capsules negatively affects the operations required for preparing or packaging the bottle, which operations would comprise the filling-in of the bottle with the product, the insertion of the rod element and ball element assembly inside the bottle neck, and the final threading of the capsule or cap on the bottle.

A further problem of prior metering capsules is that, in order to apply said capsules to small size bottles, it is necessary to form special threads, which are different from the corresponding like-size standardized threads, since the inner diameter of the neck of small bottles is not sufficient to receive therein a ball element—rod element assembly.

From the above it should be apparent that it would be actually desirable to provide a metering capsule for controllably metering products held in bottles or the like, allowing to overcome the above mentioned problems. The document GB-A-2 195 246 discloses a capsule substantially according to the preamble of claim 1.

SUMMARY OF THE INVENTION

Accordingly, the aim of the present invention is to provide such a capsule or cap, including a metering ball element for controllably metering a product, which capsule includes a minimum number of component pieces and can be threaded to bottles or containers having a neck provided with a standard thread thereby allowing to greatly reduce the making and packaging cost of the bottle the capsule is applied to.

Said aim is achieved by the present invention which specifically relates to a capsule for controllably metering products held in bottles or the like, comprising a ball element designed for controllably distributing a product on an application surface therefor, and having the characterizing features of the characterizing portion of claim 1.

According to a preferred embodiment of the present invention, the bottle neck engagement means comprise a threaded portion engaging with a corresponding threaded portion provided on said neck of said bottle the threaded portions of the engagement means and of the bottle neck having standardized threads.

The capsule or cap for controllably metering products held in bottles according to the present invention provides, with respect to the prior art, the following advantages.

Firstly, the capsule or cap according to the present invention is so made to form an integral body, including in its inside said metering ball element, and which can be applied to the bottle without using any rod elements, thereby allowing to reduce the number of component pieces required for making the metering bottle.

Secondly, by using the capsule according to the present invention, the packaging operation for providing a finished product are greatly simplified since, for providing said finished product, it would be merely sufficient to fill-in the bottle with the product and then thread the capsule on the neck of the bottle.

Finally, the specifically designed configuration of the metering capsule according to the present invention will allow to use bottles having standard threads, thereby greatly reducing the making cost thereof.

BRIEF DESCRIPTION OF THE DRAWINGS

Further advantages and characteristics of the present invention will become more apparent from the following disclosure, given by way of an illustrative but not limitative example, with reference to the accompanying drawings, where.

DESCRIPTION OF THE PREFERRED EMBODIMENTS

Figure 1:
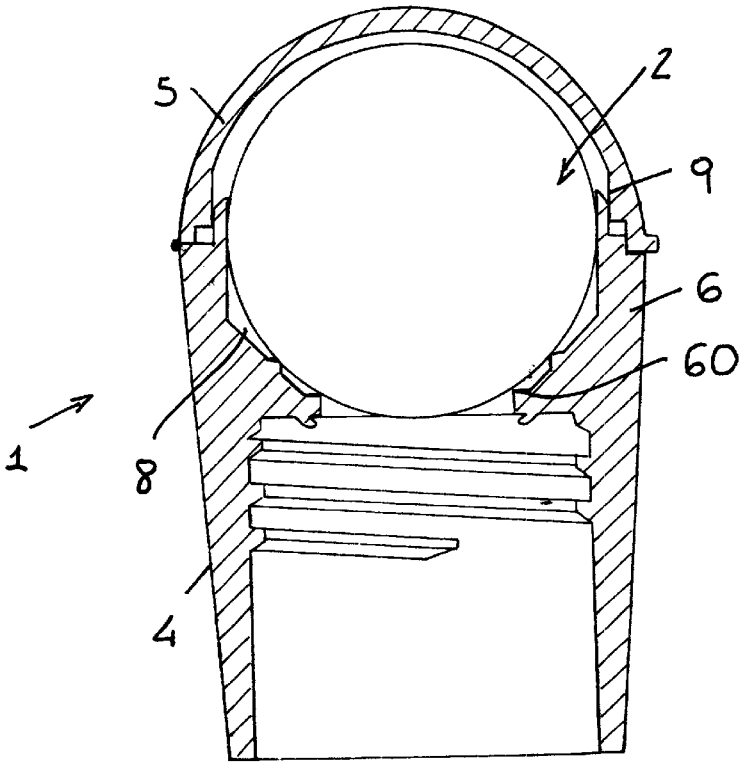
FIG. 1 is a cross-sectioned view of a metering capsule according to the present invention, as applied to the neck of a bottle, in a closed condition thereof.

In the following disclosure, reference will be made to some preferred embodiments of the present invention, given by way of a not limitative example of several possible variations of the invention.

A first exemplary embodiment of the capsule for controllably metering products held in bottles or the like, according to the present invention, generally indicated by the reference number 1, comprises a ball element 2 designed for controllably metering or delivering the products on an application or delivery surface thereof.

As shown, said ball element 2 is housed inside a holding body 6, which is provided with a cover 5, having a substantially semispherical configuration and which can be opened to expose the top portion of the ball element 2.

Preferably, the cover 5 can be opened by causing it to turn with respect to a hinge 30, and it, in a closure condition thereof, will engage, in a fixed-joint relationship, by a portion 9 thereof, with the top holding ring 7.

As shown, the mentioned holding body 6 comprises said top holding ring 7 as well as a bottom holding ring 60, the latter being adapted to support or bear thereon said ball element 2.

The bottom holding ring 60, in particular, is arranged on the top of the edge or rim 40 of the neck 3 of the bottle.

Thus, the ball element 2 will be also housed on the top of the rim or edge 40 of the bottle neck 3.

The holding body 6 is so arranged or constructed to define a space 8 for allowing the product being delivered to pass therethrough, in a controlled manner, by rotatively driving the ball element 2.

Moreover, said holding body 6 is provided with a threaded portion 4 engaging with a corresponding threaded portion provided on the bottle neck 3.

Figure 3:
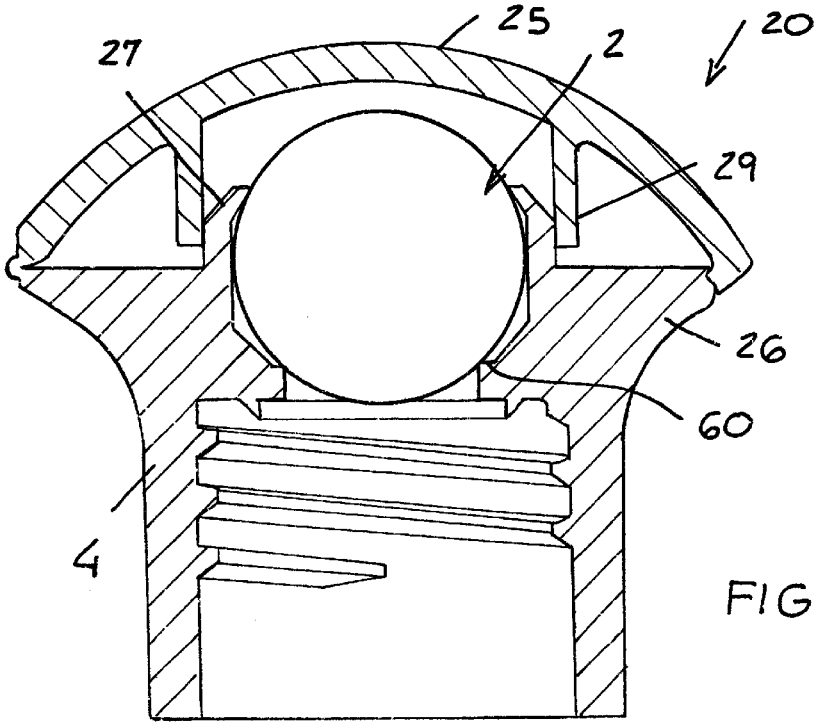
FIG. 3 is a further cross-sectioned view of a metering capsule according to a further embodiment of the present invention, as applied to the neck of a bottle, in a closed condition thereof.
Figure 2:
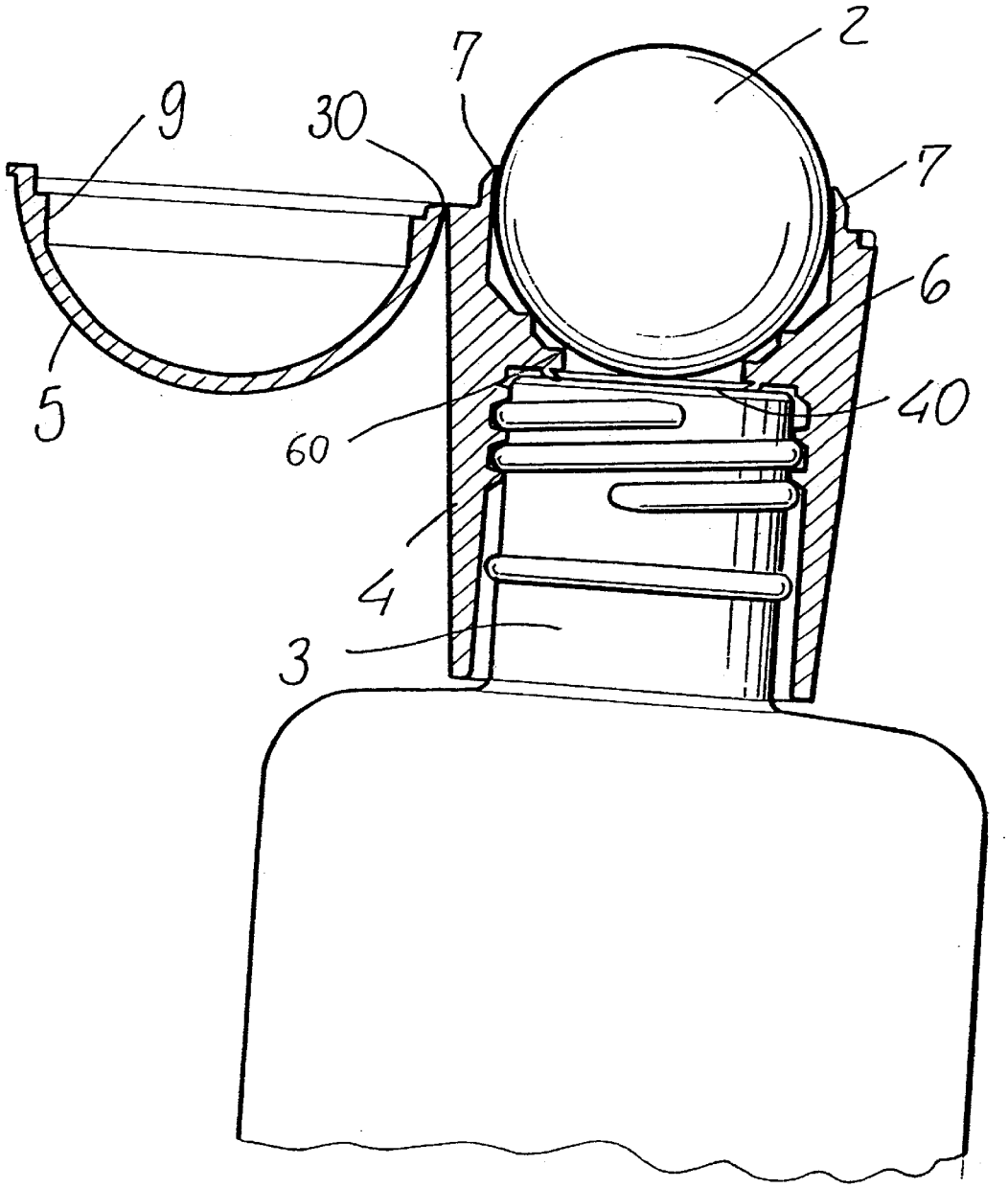
FIG. 2 is a further cross-sectioned view of the metering capsule or cap of FIG. 1, applied to the neck of the bottle, in an open condition thereof.
Figure 4:
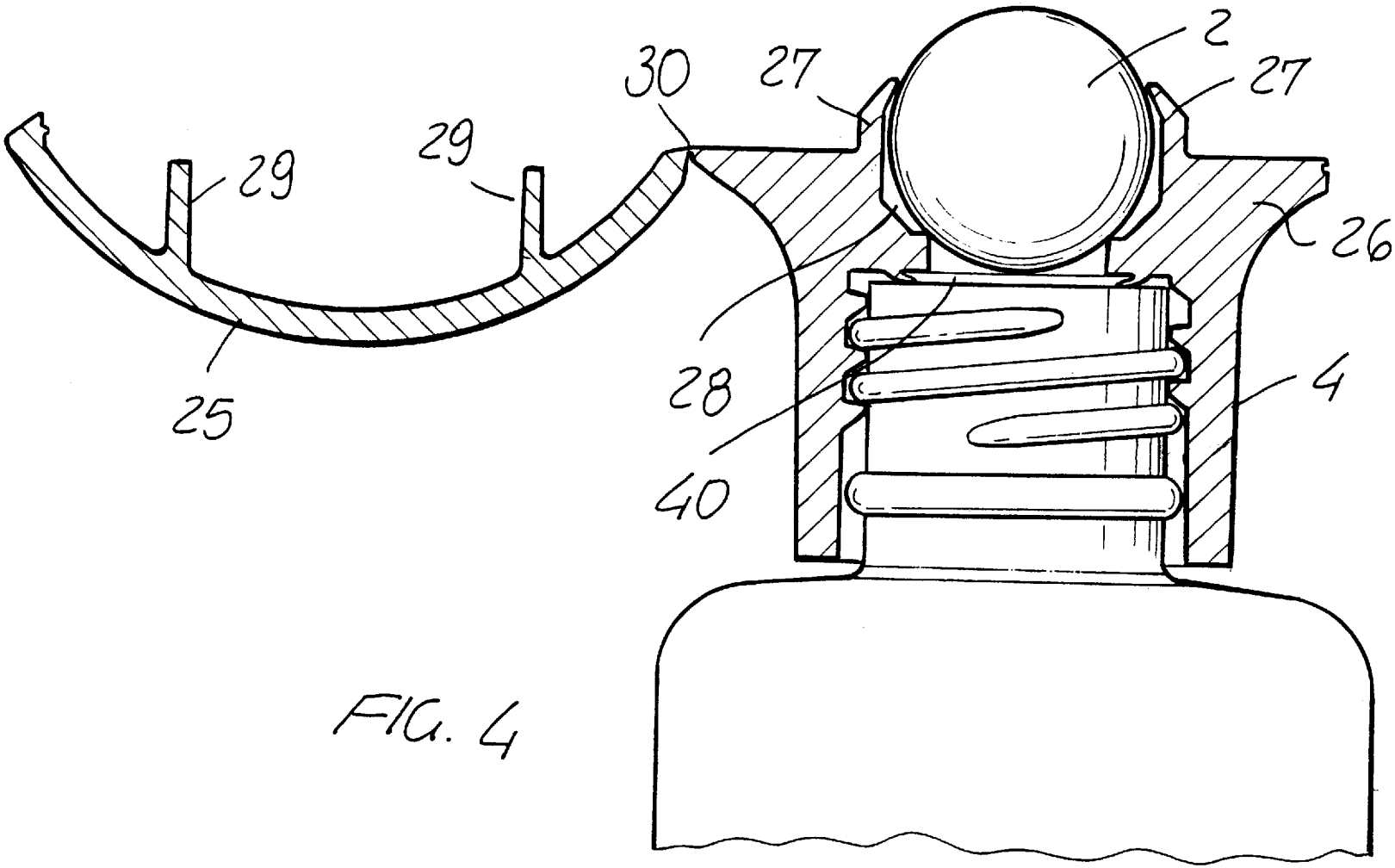
FIG. 4 is yet another cross-sectioned view of the metering capsule of FIG. 3, as applied to the neck of the bottle, in an opened condition thereof.

A second exemplary embodiment of the capsule or cap according to the present invention is shown in FIGS. 3 and 4 and is herein generally indicated by the reference number 20.

In this embodiment, the ball element 2 is housed on the top of the rim 40 of the bottle neck 3, inside a holding body 26, provided with a top holding ring 27 as well as with a bottom holding ring 60.

The holding body 26 is so arranged as to define therein a space 28 for allowing the product to be metered to pass therethrough, in a controlled manner, by rotatively driving the ball element 2.

The cover 25, which can be brought to an open condition by causing it to turn about the hinge 30, has a substantially spherical cap configuration and comprises engagement portions 29 for engaging the top holding ring 27 of the ball element 2.

The capsule according to the present invention operates as follows:

More specifically, the capsule or cap is threaded or screwed on the bottle neck 3 by using the threaded portion 4, after having filled-in the bottle with the product.

Thus, said capsule will form an integral body, including in its inside the ball element 2 for controllably delivering or metering the product; said integral or single body can be associated to the bottle in a very simple manner.

In order to use the product, it will be sufficient to open the cover of the capsule by causing it to turn about the hinge 30, thereby exposing the top surface of the ball element 2.

Thus, the product will be metered, according to a per se known method, by causing the ball element 2 to slide on the product application surface.

What is claimed is:

1. A capsule for controllably metering products held in a bottle having a bottle neck, said bottle neck having a bottle neck top provided with a top rim, comprising a ball element for controllably distributing a product on an application surface therefor, said ball element being housed inside a holding body comprising at least a top holding ring and at least a bottom holding ring therebetween and thereagainst said ball element is rotatably supported, said holding body being provided with a top hinged cover which can be opened to expose a top portion of said ball element and with engagement means for engaging said bottle neck, wherein said engagement means comprises a standardized thread on an inner surface of said holding body engageable with a mating standardized thread formed on an outer surface of said bottle neck wherein said holding body, as engaged with said bottle neck is arranged so that said ball element is held adjacent to said top rim of said bottle neck top, wherein said bottom holding ring is arranged on said bottle neck, and wherein said cover in a closure condition thereof is fixedly engaged by a portion thereof with said top holding ring.

2. A capsule, according to claim 1, wherein said cover comprises engagement portions for engaging said top holding ring against which said top portion of said ball element rotatably abuts.

* * * * *